United States Patent [19]

Andreasson

[11] Patent Number: 4,542,275

[45] Date of Patent: Sep. 17, 1985

[54] ELECTRICAL CHAIN WELDING MACHINE

[76] Inventor: Olof I. Andreasson, Tegen 2535, S-458 02 Ödeborg, Sweden

[21] Appl. No.: 478,535

[22] Filed: Mar. 24, 1983

[30] Foreign Application Priority Data

Mar. 26, 1982 [SE] Sweden ..... 8201960

[51] Int. Cl.[4] ..... B23K 11/32

[52] U.S. Cl. ..... 219/51; 219/97; 219/101

[58] Field of Search ..... 219/51, 52, 101, 97

[56] References Cited

U.S. PATENT DOCUMENTS 4,051,667 10/1977 Lange ..... 219/51 X

*Primary Examiner*—Roy N. Envall, Jr.
*Assistant Examiner*—Alfred S. Keve

[57] ABSTRACT

A machine for electrical resistance welding of chain links has upsetting bars (10) which are engaged against the arcuate ends of a chain link (1). On either side of the welding zone the legs of a link are gripped by pairs of electrodes (12) attached to the ends of a two-armed clamp (14). The arms (13) of the clamp are mounted for pivoting in a plane at right angles to the chain link, and also about an axis in this plane extending at right angles to the upsetting direction and passing through journalling head (20) attached to the end of a piston rod (21) of a counteraction cylinder (20). The ends remote from the electrode jaws (12) of the clamp arms (13) are acted on by an operation cylinder (30) which, via a link system (16, 16), gives the clamp a gripping movement about the link leg. The cylinder (20) with cylinder (30) and the clamp (14) commonly form a welding head which is pivotable about an axis (z—z) at right angles to the upsetting direction. By balancing operation pressure from the operation cylinder (30) and the counteraction cylinder (20) during swinging of the welding head about the axis (z—z), the clamp (14) is caused to follow the positional alteration, during the upsetting movement, of the portion of the chain link surrounded by the electrodes, this portion being simultaneously guided by the electrodes (12). The apparatus allows undisturbed current supply from the electrode jaws to the link without any slip, as well as improved guidance of the link portions during the upsetting sequence.

10 Claims, 4 Drawing Figures

ELECTRICAL CHAIN WELDING MACHINE

The present invention relates to an electrical chain welding machine designed to join by resistance welding the open ends of a pre-shaped chain link, upsetting bars which are movable towards each other being engaged against the arcuate ends of the chain link so that the facing surfaces of the free legs thereof are moved into mutual contact in a welding zone. The necessary welding current passes through the welding zone with the aid of electrodes in contact with the link legs on either side of the zone. When the ends of the link are upset, the legs are moved towards each other, both towards the welding zone (the upsetting direction) and transverse thereto during a change of the angular attitude of the legs.

In the art, welding chain links are generally accomplished by resistance welding in the form of resistance-butt welding, projection welding or flash welding. The selection of welding is determined by the dimensions of the chain and the requirements placed thereon. The guidance of the links as well as the uniformity of the current flow through the weld constitute significant factors in the welding sequence.

Resistance-butt welding and projection welding are preferably used for lighter dimensions of chain with a link diameter of up to about 25 mm. The link is pre-shaped so that its free facing surfaces are at a given small distance from each other, the legs each forming a slight angle of about 5° diverging from the longitudinal axis of the link. Opposing forces are applied during welding to the arcuate ends of the link and in the direction of its longitudinal axis. This is done with the aid of upsetting bars. The link, and preferably its back portion is subjected to bending until the facing surfaces are brought into mutual contact while aligning the legs along a substantally straight line. The original slope of the pre-shaped legs is intended to compensate for the angular alteration caused by upsetting.

The facing surfaces are urged towards each other with relatively large force during resistance-butt welding. After heating caused by the welding current, the material softens in the welding zone and is upset to form a bead around the zone. The facing surfaces of the link legs are substantially planar and extend at right angles to the longitudinal direction of the legs. Conventional resistance-butt welding of chain links has the advantage of working relatively rapidly and economically, but there are certain difficulties in obtaining uniform heat distribution in the weld and forcing out contaminant material in the form of slag etc. from the weld during upsetting. A further disadvantage in known applications of resistance-butt welding is concerned with the unsatisfactory alignment of the link legs during the upsetting process.

Known machines for resistance-butt welding of chain links are provided with apparatus for compressing the bead formed around the welding zone. The apparatus consists of a pair of dies, one on either side of the welding zone, each capable of being pressed against a half of the hot bead so that the material in it is distributed along the surfaces of the link legs after completed welding and upsetting. There is simultaneously achieved some evening-out of lateral displacement of the link legs and faying surfaces occurring during the upsetting process. However, this method has the disadvantage that slag etc. in the bead will be forced back into the weld or the contiguous portion of the welding zone. The weld, already imperfect due to the previous contaminations is thus further deteriorated. The resistance-butt method is therefore unsuitable for high-strength chain for this reason already, particularly if the chain is going to be hardened. Neither can the incomplete guidance of the link legs during upsetting, with the risk of lateral displacement of the faying surfaces, be accepted for high-strength chain.

Projecting welding is a developed form of the resistance-butt welding described above. The difference in the two is that the facing surfaces are embossed to a configuration giving improved heat distribution in the weld and thereby a better result. The method can therefore be used for high-strength chain. The manufacturing process is generally directed towards greater accuracy in this case, the lateral displacement of the facing surfaces being reduced as far as possible. The weld bead is removed in this case with the aid of a cutter shaped to the configuration of the link legs, this cutter stripping off the bead during movement of it in the longitudinal direction of the legs. There is still the problem of ensuring correct guidance of the link legs towards each other, although projection welding does provide better heat distribution in the weld and a higher quality of it, since slag inclusions are avoided. The production rate is comparatively high and requires expensive machines.

In both resistance-butt welding and projection welding, the welding current is provided by electrodes placed around the free link legs on either side of the welding zone. The electrodes, formed as jaws, are adapted so as to accompany the movement of the link legs in the upsetting direction and in a direction at right angles thereto. On the other hand, the jaws do not accompany the swinging movement, or angular change to which the free legs are subjected by the deformation of the link during the upsetting process. This involves a considerable disadvantage, in that the current transfer at the place of contact between electrode jaw and link leg is subjected to disturbances with accompanying non-uniform current flow through the welding zone and uneven heat distribution in the weld. Furthermore, there is also the risk of burns on the link leg at the place of contact, which can result in stress concentrations and deterioration of the link strength.

The Swedish Patent Specification No. 209907 describes an electrical chain welding machine where the electrodes are said to be stiffly connected to the upsetting slides for compulsory accompanyment in the upsetting direction during the upsetting process. In this known case, the electrodes merely move in parallel motion without accompanying a swinging motion or the angular alteration of the link legs which also occurs during the upsetting process.

Flash welding is the welding method which is preferably used at present in the manufacture of chains having a link diameter of over 25 mm. The heavy chain diameters in question put high demands on the execution of the weld, which has so far only been able to be achieved with the aid of this welding method, in flash welding, the faying surfaces are first heated by being moved backwards and forwards towards each other, current transfer taken place when these surfaces are in contact and the heat generated evened-out when the facing surfaces are separated. After this heating, there is a flashing sequence during which the facing surfaces are moved with low and controlled speed towards each other. During the process, small contact bridges are formed over the entire interface, where current with great density passes through and heats the bridges until they fuse. The weld is completed by a rapid compression, fused material being pressed out from the welding zone and welding taking place between the underlying heated material. The flashing sequence cleans the facing surfaces and heat distribution over the weld will be good.

A necessary condition for flash welding is completely slip-free current transfer from the electrode jaws. Displacement of the facing surfaces must not take place, since the bead formed during welding cannot then be scaled off.

In known machines for flash welding chain links, the electrode jaws transfer both welding current and upsetting force. The link is clamped so that its legs are displaced while in alignment with each other. The link is thus not bent as with upset welding. The deformation of the link gives rise to a complicated stress condition resulting in that very great forces must be applied via the electrode jaws to deform the link, particularly in cases where the link is cold. The electrode jaws must be applied to the link legs with large clamping forces so that they can displace and guide the link legs. Flash welding machines for chains must therefore have a very robust structure, thus being corresondingly expensive in manufacture. The production rate is also comparatively low.

A known variant of the flash welding method is that heating the facing surfaces does not take place during the reciprocal movement but during the flashing process itself, which may then take place during a longer period of time and with successively increasing speed towards each other of the facing surfaces (flash welding with direct flashing).

The present invention has the object of providing an apparatus for electrical welding chain links, wherein the facing surfaces of the legs of the pre-shaped open link are guided towards each other under completely slip-free current transfer between electrode jaws and link legs. The link leg is deformed in a similar way as with resistance-butt welding, the legs guided so that lateral displacement of the facing surfaces is avoided. The apparatus may be used for all resistance welding of chain links, such as resistance-butt welding, projection welding and flash welding. For the latter is used the variation with direct flashing.

This object is achieved by the electrical chain welding machine in accordance with the invention.

To ensure slip-free gripping about the link leg, the gripping surfaces of the electrode jaws are arranged with contours complemental to the contour of the leg.

In one advantageous embodiment, the electrode jaws are attached to the ends of the electrode clamp arms, the other ends of which are guided via a V-shaped pair of links from a power source acting to force the jaws against the link leg and give the clamp a swinging movement accompanying the angular alteration of the link leg during the upsetting sequence, the clamp also having freedom for parallel motion displacement in the upsetting direction and at right angles thereto by the clamp being able to swing about an axis at right angles to the upsetting direction, said axis passing through a journalling head attached to the end of a piston rod of a counteraction cylinder pivotable about a fixed axis and excercising a balancing counter force against said power source.

The power source for applying clamping force and for swinging the clamp suitably comprises an operation cylinder for supplying compressive force, rigidly connected to the counteraction cylinder.

The operation cylinder may suitably be connected to the arms of the clamp via ball joints, and these arms may be mounted for pivoting in the plane of the clamp in clevises rotatably mounted in a journalling head on the ram end of the counteraction cylinder, about the axis which is movable in parallel motion and at right angles to the upsetting direction.

In a particularly advantageous embodiment the welding head comprising electrode clamp, operation cylinder and counteraction cylinder is connected to the upsetting bar operation means such that the welding head swinging motion and thereby the movement of the electrode jaws at right angles to the upsetting direction is controlled during the upsetting sequence.

The connection between the welding head and the upsetting bar operation means may comprise an adjustable toggle joint, an electronically controlled screw driven by an electric motor or a hydraulic cylinder with electronically controlled delivery of pressurized fluid for positioning the piston of said cylinder.

The invention will now be described below in the form of an embodiment, with reference to the accompanying drawings on which:

Figure 1:
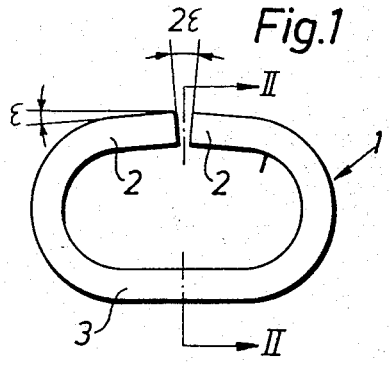
FIG. 1 is a side view of a pre-shaped chain link before welding.
Figure 2:
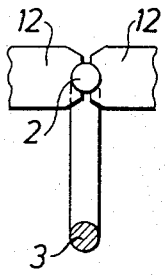
FIG. 2 is a section along the line II—II in FIG. 1, illustrating the connection of electrode jaws to the link leg, FIG. 3 schematically illustrates a welding head and associated parts in a chain welding machine in accordance with the invention.

In FIG. 1 there is illustrated a chain link 1 in a pre-shaped condition for resistance welding the free legs 2 of the link. As will be seen from the Figure, the legs form an angle $\epsilon$ with the longitudinal direction of the link. In the Figure, the facing surfaces of the legs are cut substantially at right angles to the legs for containing an included angle of $2\epsilon$. The facing surfaces may also be embossed or formed in some other way so that favourable conditions for good heat distribution are obtained. The inclination of the legs is selected such that they will be in line with each other after upsetting. When the legs are upset, which is carried out by applying opposing forces to the arcuate ends of the link, the link is essentially subjected to pure bending, preferably of its back portion 3. The facing surfaces of the legs are moved together and united by resistance-butt welding. The necessary current is supplied via electrodes connected to the respective legs 2. It is necessary, for obtaining a satisfactory weld and an otherwise acceptable chain link, that the welding current may flow through the welding zone without disturbances and with the required strength, as well as the legs being guided so that their facing ends are in register in the welding position, with the legs in alignment. A condition for obtaining this is that the electrodes which are connected to the respective legs 2 are implemented such that they surround the legs around the greater portion of their circumference, as illustrated in FIG. 2.

The legs are generally subjected to an angular alteration of about 5° when the link is deformed by upsetting, i.e. the angle $\epsilon$ should correspondingly be about 5°.

It will be understood that a certain amount of lateral displacement of the legs 2 can occur during the deformation of the link, when such deformation is provided merely by applying opposing side forces according to the above, without any particular control of the legs 2 having been arranged. This results in that the final weld will be unsatisfactory and that it generally affects the strength of the link.

In resistance-butt welding, the bead formed is indeed pressed out with a certain amount of evening-out of the material around the welding locaion, but this is not sufficient for providing a perfect link. This measure also causes slag from the upset metal to be pressed into the weld and cause its deterioration. In projection welding, the deformation of the link must in any case take place such that the legs 2 more or less come in line, it being otherwise impossible to slice off the bead of upset metal.

Flash welding with direct flashing and one-way movement of the facing surfaces is only possible to apply to a link according to FIG. 1, when the legs thereof are accurately guided towards each other without lateral displacement, so that the position of the facing surfaces is kept under accurate control during the welding operation itself, and so that subsequent removal of excess metal can be carried out.

Figure 3:
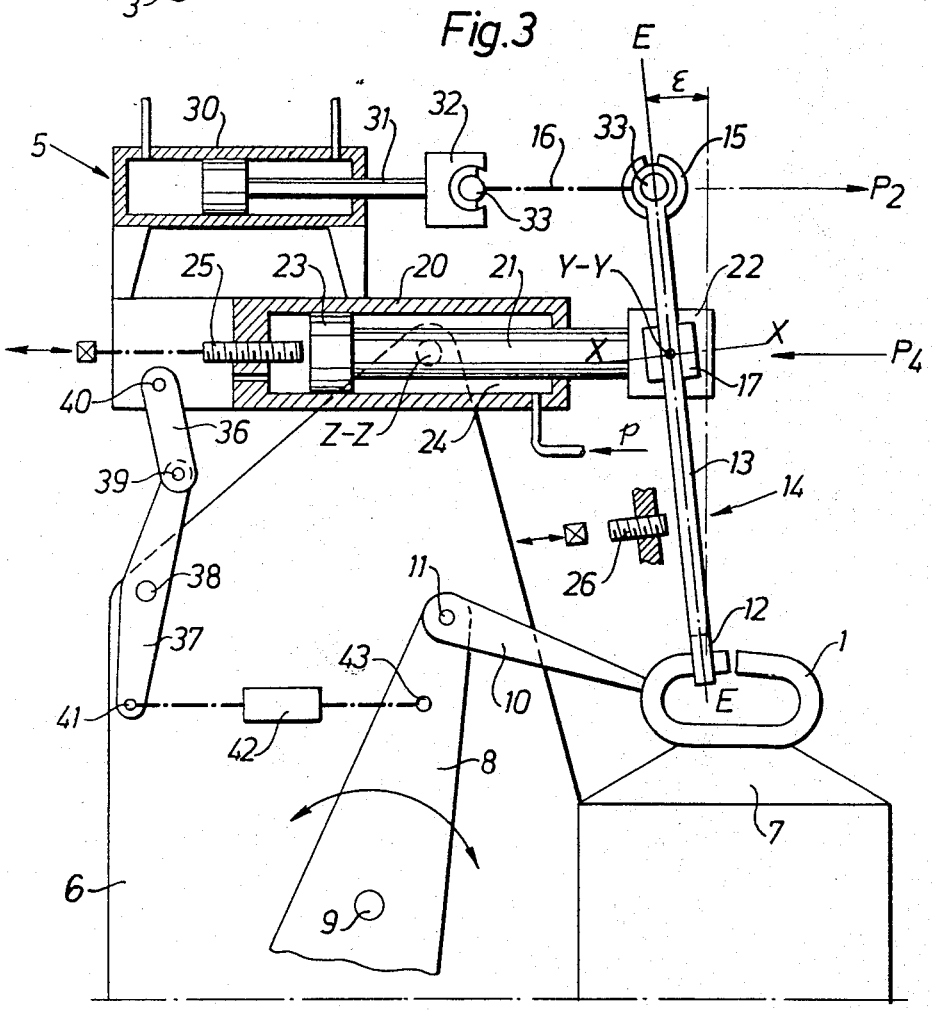
Figure 4:
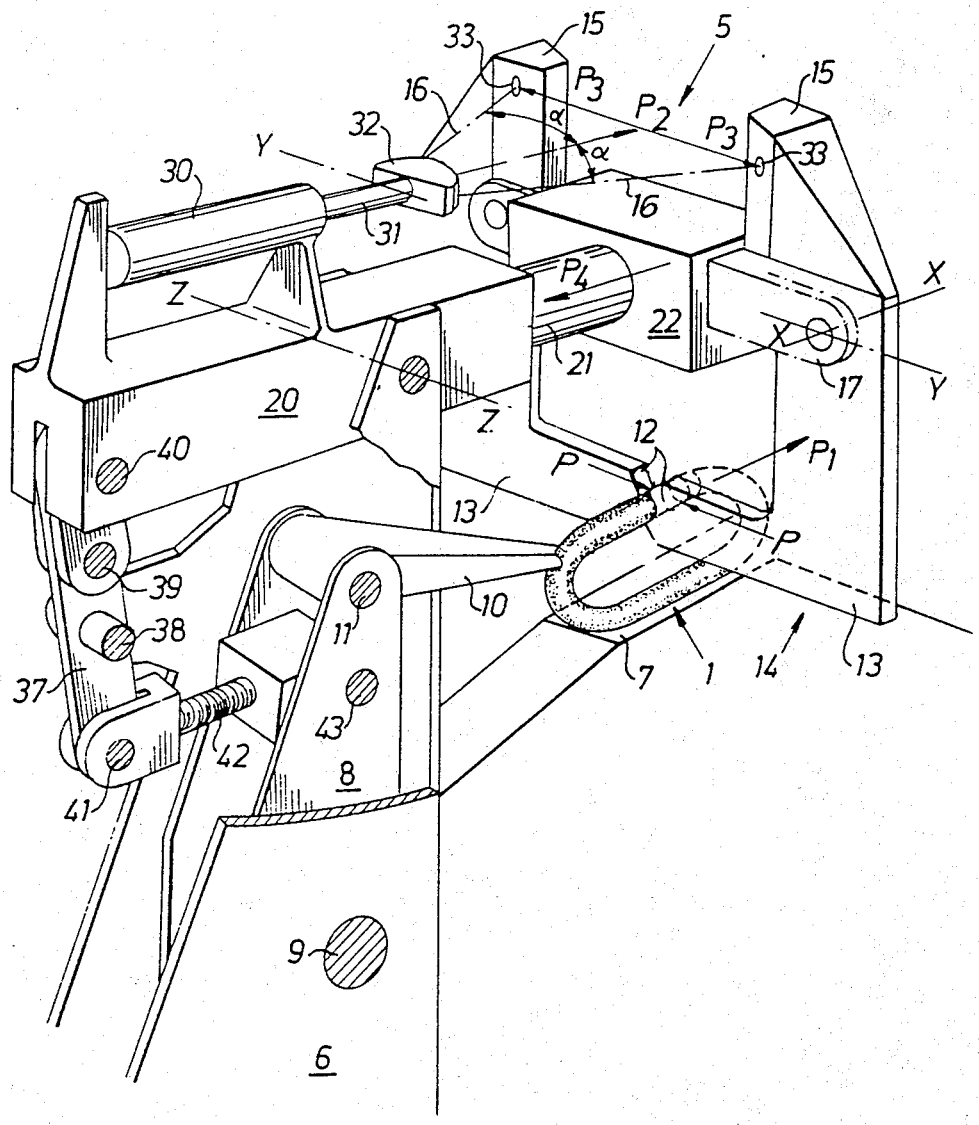
FIG. 4 is a perspective view of the welding head on a larger scale.

FIGS. 3 and 4 illustrate a welding head for an electrical chain welding machine in accordance with the invention. According to the Figures, only the left-hand welding head of such a machine is illustrated. The right-hand welding head of the machine is identically to opposite hand of the left-hand head. It will be appreciated that in operation a complete chain welding machine has one end of such heads.

The chain link 1 is supported conventionally by a so-called anvil 7 associated with the machine. In manufacturing a chain, chain links gripping round each other are conventionelly fed into the machine and the links welded in an on-edge attitude according to FIGS. 1 and 3. Further portions of the chain links engaging round the link 1 are not shown in the Figures, for the sake of clarity.

In resistance welding a chain link in accordance with the invention, the link is conventionally upset with the aid of upsetting bars 10 applied against arcuate ends of the link 1. Movement of the upsetting bar is translated by an operating arm 8 pivotable about an axis 9. The associated driving mechanism for this arm is conventional and therefore not illustrated further. The mechanism for this movement operates in time with the advance of each chain link. The arm 8 is mounted in the machine frame 6 about its pivoting axis 9, and the upsetting bar 10 is mounted on the arm 8 at a pivoting point 11 with the availability of a certain amount of angular alteration to its bearing point on the arm so that the upsetting bar can be applied in a desired position on the chain link and execute a small oscillating movement relative the arm 8 during to upsetting sequence.

The welding head 5 is provided with a clamp 14 including two arms 13. These arms each carry in their dependent first ends an electrode jaw 12 with a contact surface complemental to that of the leg 2 (FIG. 2) of the chain 1. Each arm 13 is pivotable about an axis x—x extending substantially in the upsetting direction. Said axis is the center line of a pin in a clevis 17, both clevises being in line with each other and pivotable about an axis y—y extending at right angles to the upsetting direction.

The term "upsetting direction" is here to be understood as a direction substantially parallel to the longitudinal direction of the chain link 1.

The two clevises 17 are non-rotatably attached to each other via a shaft extending through a journalling head 22, with the clevises on either side of this head and with their openings facing away therefrom. This head is rigidly attached to the outer end of a piston rod 21 which, while being unrotatably guided in a counteraction cylinder 20, is movable substantially in the upsetting direction. The piston rod 21 is for pulling, and together with the cylinder 20 and piston 23 encloses a pressure chamber 24 in continuous communication with a source of hydraulic pressure at a pressure p. This hydraulic pressure p can be adjusted as required so that the backward movement of the piston in the cylinder is limited by a settable stop 25. The space behind the piston 23 is vented. The counteraction cylinder 20 is pivotably mounted on the frame 6 on a fixed axis z—z, at right angles to the upsetting direction.

An operation cylinder 30 is rigidly attached to the counteraction cylinder 20. The former cylinder may be adapted for hydraulic or pneumatic operation, and is double acting with its line of action parallel to that of the piston rod 21. The piston rod 31 of the operation cylinder 30 is provided with a coupling head 32 for ball joints 33 and link arms 16 which distribute the force provided by the cylinder to the free ends 15 of the electrode clamp arms 13. As will be seen from FIG. 4, the links 16 form a V symmetrically arranged about the central plane through the link 1 and cylinders 20, 30.

The apparatus functions in the following manner.

After advancing a chain link 1 into the welding position on the anvil 7, the welding head is in the initial state illustrated in FIG. 3. The piston 23 is taken into abutment against the stop 25 by the continuously applied pressure p. The coupling head 32 is in a retracted position in a direction to the left in FIG. 3. The clamp 14 slopes towards the left in the Figure so that a plane E—E through the clamp arms 13 forms the angle $\epsilon$ with a plane at right angles to the upsetting direction. Counter-clockwise rotation of the clevises 17 about the axis y—y is limited in this position by a stop (not shown) on the journalling head 22. During retraction of coupling head 32 towards the left in FIG. 3, a force component at the end 15 of each arm 13 (electrode arm) in the clamp is formed by tension in the link arms 16, such that the ends 15 are moved towards each other and the electrode jaws 12 open. This movement is limited by the clamp arms abutting against a stop on the clevises 17. These stops are not more closely shown.

In conjunction with the start of the upsetting sequence, operation pressure is applied to the operation cylinder 30, so that the coupling head 32 is taken to the right in FIG. 3. A force $P_2$ is thus caused to act via the links 16 on the clamp 14 urging it to swing about the axis y—y, clockwise in FIG. 3. A counter force $P_4$ is exercised on the journalling head 22 via the hydraulic pressure p in the counteraction cylinder 20. Without the application of another force, the clamp 14 would now swing about the axis y—y. This is, however, prevented by an adjustable stop 26 coming up against the clamp arms (electrode arms). The stop can be arranged for merely one arm, since both arms are mutually unrotatable about the y—y axis, or said stop may be applied to both arms. The V-inclined links 16 develop opposing outwardly directed force components at the ends 15 of the arms 13, whereby the arms are swung so that electrode jaws 12 grip round the leg 2 of the chain link 1. There is thus developed a pressure P from each electrode jaw against the leg 2 and a corresponding frictional force $P_1$ in the longitudinal direction of the leg. The following relationship between developed forces is applicable.

$$P = \frac{P_2 \cdot \tan \cdot a}{2 \cdot b}$$

$$P_1 \leqq k \cdot P$$
$$P_4 \cdot b = P_2(a + b)$$
$$P_4 = P_1 + P_2$$

where a=lever arm between the connection point 15 of the clamp arm and the pivoting axis y—y b=lever arm between the point of action at the electrode jaw and the pivoting axis y—y $\alpha$=angle between link 16 and the central plane of the welding head k=coefficient of friction between electrode jaw and chain link.

By adjustment of the counter pressure p and operating pressure to the cylinder 30 there is obtained a suitable balance between developed forces so that the electrode jaws 12 are retained by friction in their position of engagement against the link. During the upsetting sequence, the clamp 13 and jaws 12 are caused accurately to accompany the positional alteration of the link leg 2 both with regard to it displacement in the upsetting direction and at right angles thereto as well as in respect of its angular alteration. By the action of the operating force from the cylinder 30 under balanced counteraction from the counteraction cylinder 20, the slope of the clamp plane E—E will accompany the angular alteration of the leg 2 and movement in the upsetting direction of said leg, while movement at right angles to the upsetting direction by the clamp 14 is enabled by the welding head 5 swinging about the axis z—z. The electrode jaws 12 simultaneously guide the leg laterally (at right angles to the plane of FIG. 2) when the clamp arms 13, together with the links 16 form a statically determined spacial framework.

Sufficient guidance of the leg 2, even at right angles to the upsetting direction, can be counted on as being obtainable in practice according to the above. The welding head 5 thus swings freely about the axis z—z. For further ensuring accurate guidance, also perpendicular to the upsetting direction, the swinging movement of the welding head can be coupled to the operating means 8 for upsetting. Such a connection can be carried out in the form of a toggle illustrated in FIGS. 3 and 4. The toggle comprises a link 36 pivotably connected at 40 to the counteraction cylinder 20, the other end of the link being pivotably connected to a first lever 37 at 39, the lever having its fulcrum at 38 in the frame 6. The other end of the lever 37 is pivotably connected at 41 to an adjustable coupling member 42, the other end of which is pivotably connected to the operating means 8 at 43. The length of the member 42 may be altered, e.g. with the aid of a screwed connection, so that the sweep or stroke of the swinging connection point 39 is changed. As will be seen from FIG. 3, the connection point 40 on the counteraction cylinder 20 is raised when the operating means 8 pivots in the upsetting direction. The electrode jaws 12 accordingly strive to guide the leg 2 towards the back of the link. However, it may be the case that the link is pre-shaped so that after the upsetting sequence the leg would be bent too far in towards the back of the link. This may be corrected by allowing the welding head 5 to swing in the opposite direction, whereby the electrode jaws 12 will straighten out the leg 2, away from the back of the link so tht the desired final position of the leg is thus obtained. The toggle is adjusted in such a case so that the links are on the opposite side of the dead center point compared with the position illustrated in FIG. 3.

It is also possible to arrange an electronically controlled connection between the operating means 8 and the counteraction cylinder 20. Such a coupling may include a motor driven screw, the motor being regulated electronically from sensors indicating the position of the upsetting bar.

Such a coupling means may also comprise a hydraulic cylinder, the setting position of which is regulated by electronically controlled hydraulic means from sensors indicating the position of the upsetting bar.

The latter means are particularly suited for use in coaction with a program-controlled upsetting movement adapted for flash welding with direct flashing, the facing surfaces being moved towards each other according to a regulated program.

I claim:

1. A chain welding machine comprising: two mutually opposing upsetting bars for engaging opposite arcuate portions of a pre-shaped open chain link having two spaced legs, and means for displacing the legs toward each other in upsetting direction, and in a direction transverse thereto, into mutual contact at a welding zone in a central upsetting plane, and for altering the angular attitude of the legs with respect to each other, separate electrodes on either side of the welding zone, said electrodes having associated holders forming a clamp with two arms having two opposing electrode jaws for gripping a respective link leg, means for supporting and guiding the arms of the clamp for pivoting about a pre-determined axis for symmetrical pivoting relative to the upsetting plane of the clamp arms about a respective first axis essentially parallel to the longitudinal direction of the chain link at a predetermined equal distance from the upsetting plan and parallel to said plane; and for pivoting of each clamp arm about a common second axis perpendicular to the upsetting plane and intersecting said first axis.

2. A chain welding machine as claimed in claim 1, wherein said electrode jaws have gripping surfaces respectively complementary to the contours of the link leg approximately completely engaging the leg to ensure gripping of the leg.

3. A chain welding maching as claimed in claim 1, wherein said two arms of the clamp each constitute a lever carrying at a first end respectively an electrode jaw, and at a second opposite end being pivotably connected to a link mechanism of a pair of link mechanisms having a V-shaped configuration, ends of said link mechanisms being connected to a common power source for the application of a force in the upsetting direction, said second ends of said arms being given force components mutually opposingly directed, which strive to swing said arms in the plane of the clamp, thereby urging the electrode jaws against the link leg, said second ends also being given a force component in the upsetting direction striving to swing the clamp in the direction of bending of the link leg during upsetting, said second axis of the clamp in said plane constituting an axis in a journalling head attached to a piston rod of a counteraction cylinder for applying a regulatable yielding counter force opposite to the upsetting direction, said counteraction cylinder being mounted about a fixed axis for pivoting in the upsetting plane.

4. A chain welding machine as claimed in claim 3, wherein the power source for applying a force to the pair of link mechanisms comprises an operation cylinder rigidly attached to said counteraction cylinder, one end of each link mechanism being connected to an end of the piston rod of the operation cylinder.

5. A chain welding machine as claimed in claim 4, comprising ball joints for connecting said link mechanisms to the clamp arms and the end of the piston rod of the operation cylinder.

6. A chain welding machine as claimed in claim 3, wherein about the second axis in the plane of the clamp there are rotatably mounted clevises in which the arms of the clamp are mounted for pivoting in the plane of the clamp, said journalling head being guided against rotation about the axis of the counteraction cylinder so that displacement of the second axis in parallel motion is assured.

7. A chain welding machine as claimed in claim 3, wherein said counteraction cylinder with the operation cylinder and the clamp are connected to operating means of the upsetting bar for controlling the common swinging movement of the cylinders and clamp about said fixed axis during upsetting so that the electrode jaws move the link leg perpendicular to the upsetting direction.

8. A chain welding machine as claimed in claim 7, wherein the connection between the operation cylinder and the upsetting arm comprises a toggle mechanism with means for mechanically adjusting the angular movement for varying the amount the counteraction cylinder pivots in alternative directions during upsetting.

9. A chain welding machine as claimed in claim 7, wherein said connection includes a screw driven by an electric motor, the connection being adjustable during upsetting depending on the position of the upsetting bar by a transducer and electronic control of the motor.

10. A chain welding machine as claimed in claim 7, wherein the connection includes a hydraulic cylinder, the connection being adjustable during upsetting depending on the position of the upsetting bar by a transducer and electronic control of the working medium of the hydraulic cylinder.

* * * * *